United States Patent [19]

Ruthen

[11] Patent Number: 4,825,766

[45] Date of Patent: May 2, 1989

[54] FUZING ARRANGEMENTS

[75] Inventor: Graham J. Ruthen, Camberley, England

[73] Assignee: EMI Limited, Hayes-Middlesex, England

[21] Appl. No.: 23,532

[22] Filed: Mar. 6, 1979

[30] Foreign Application Priority Data

Mar. 11, 1978 [GB] United Kingdom ..... 789730
Oct. 25, 1978 [GB] United Kingdom ..... 7841831

[51] Int. Cl.[4] ..... F42C 13/08

[52] U.S. Cl. ..... 102/215; 102/212; 102/397

[58] Field of Search ..... 102/19.2, 211, 212, 102/215, 216, 206, 7.4, 397, 427

[56] References Cited

U.S. PATENT DOCUMENTS 2,368,310 1/1945 Lecky et al. ..... 102/216
3,515,067 6/1970 Min ..... 102/7.4
3,699,889 10/1972 Cioccio et al. ..... 102/19.2
3,818,833 6/1974 Throner, Jr. ..... 102/7.4
3,875,862 4/1975 Fischer et al. ..... 102/19.2

FOREIGN PATENT DOCUMENTS 220324 9/1925 United Kingdom .
385595 3/1931 United Kingdom .
1162778 8/1969 United Kingdom .
1187520 4/1970 United Kingdom .
1315684 5/1973 United Kingdom .
1536065 12/1978 United Kingdom .

*Primary Examiner*—Charles T. Jordan
*Attorney, Agent, or Firm*—Fleit, Jacobson, Cohn & Price

[57] ABSTRACT

A submunition has a metallic body 1 a sensor 4 for sensing the presence of metal and an extendable probe (e.g. a spring 3) separating the sensor 4 and body 1 to avoid interference with the sensor. A circuit including the metal sensor and an impact sensor detonates the submunition if impact with a metal body is detected; if impact only is detected the submunition adopts the role of a mine.

15 Claims, 2 Drawing Sheets

SUBMUNITION RELEASE

21
BATTERY
RELEASE SENSOR
20
22
DC VOLTAGE ENHANCER
26
0·5 – 1S TIMER
23
24
24a
S & A TIMER 0·5S
HV
25
DEPLOYMENT ACTUATOR
24b
27
TARGET SENSOR
32
38
T
33
IMPACT SENSOR
I
34
37
39
SEQUENCE TIMER
0
15S
2H
36
35
40
HV
TARGET & IMPACT
TARGET
DISTURBANCE SENSOR
SELF DESTRUCT
28
29
30
31
WARHEAD

FUZING ARRANGEMENTS

The present invention relates to a fuzing arrangement, in particular it relates to a submunition including a fuzing arrangement.

It has been proposed to provide a plurality of submunitions in a canister. The canister is released from an aircraft or gun or other projector to arrive in the vicinity of a group of ground targets and the submunitions are scattered from the canister over the group of targets. It is important that those submunitions which will hit the targets are detonated at a preselected distance from each of these targets. However, the submunitions contain material which interfere with means for detecting range from a conductive target.

It is an object of the present invention to provide such submunition including a fuzing arrangement.

According to the invention, there is provided a submunition having:

a fuzing arrangement including, a first sensor means, having a sensing element and responsive to the presence of metal to produce a first signal, second sensor means having an impact sensing element and responsive to impact to produce a second signal, third sensor means responsive to a stimulus to produce a third signal, actuating means responsive to the production of the first and second signals at the same time to produce a warhead actuating signal, and to the production of a said signal only by a preselected one of the first and second sensor means to actuate the third sensor means; a body comprising material which affects the operation of the sensing element; and a member extendable from the body to support the magnetic field sensing element and an impact sensing element of the first and second sensor means respectively at a preselected distance from the body to reduce the affect of the said material on the sensing element and to sense impact with a metallic target at the preselected distance from the body.

The third sensor is preferably actuated in response to an impact alone so that the submunition acts as a mine if it does not hit a metallic target. The third sensor may be responsive to physical disturbance to detonate the submunition.

For a better understanding of the present invention, reference will now be made, by way of example, to the accompanying drawing, in which.

Figure 1:
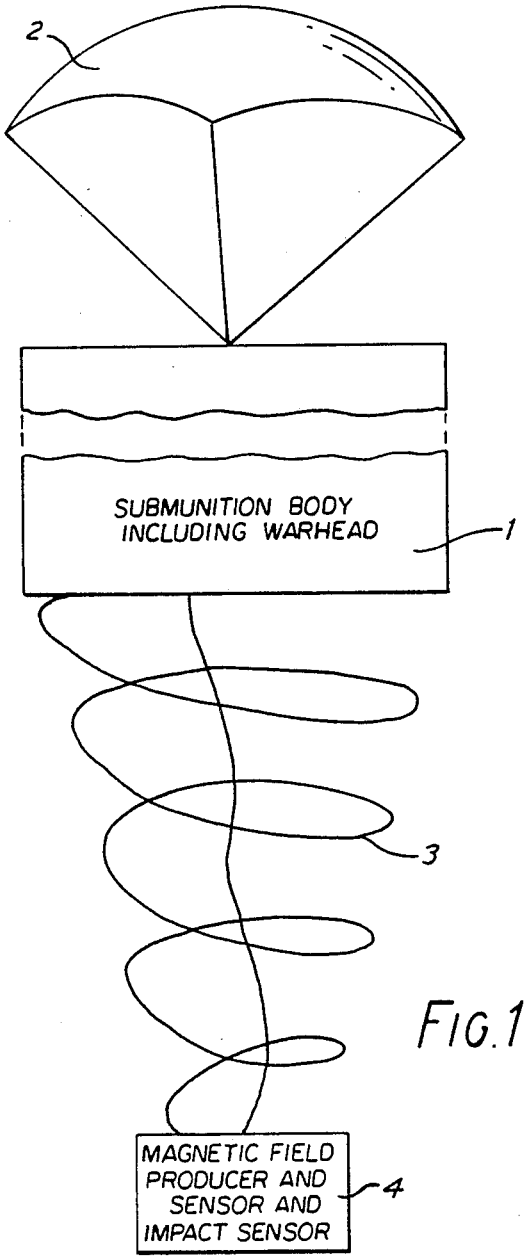
FIG. 1 shows a submunition in flight.
Figure 2:
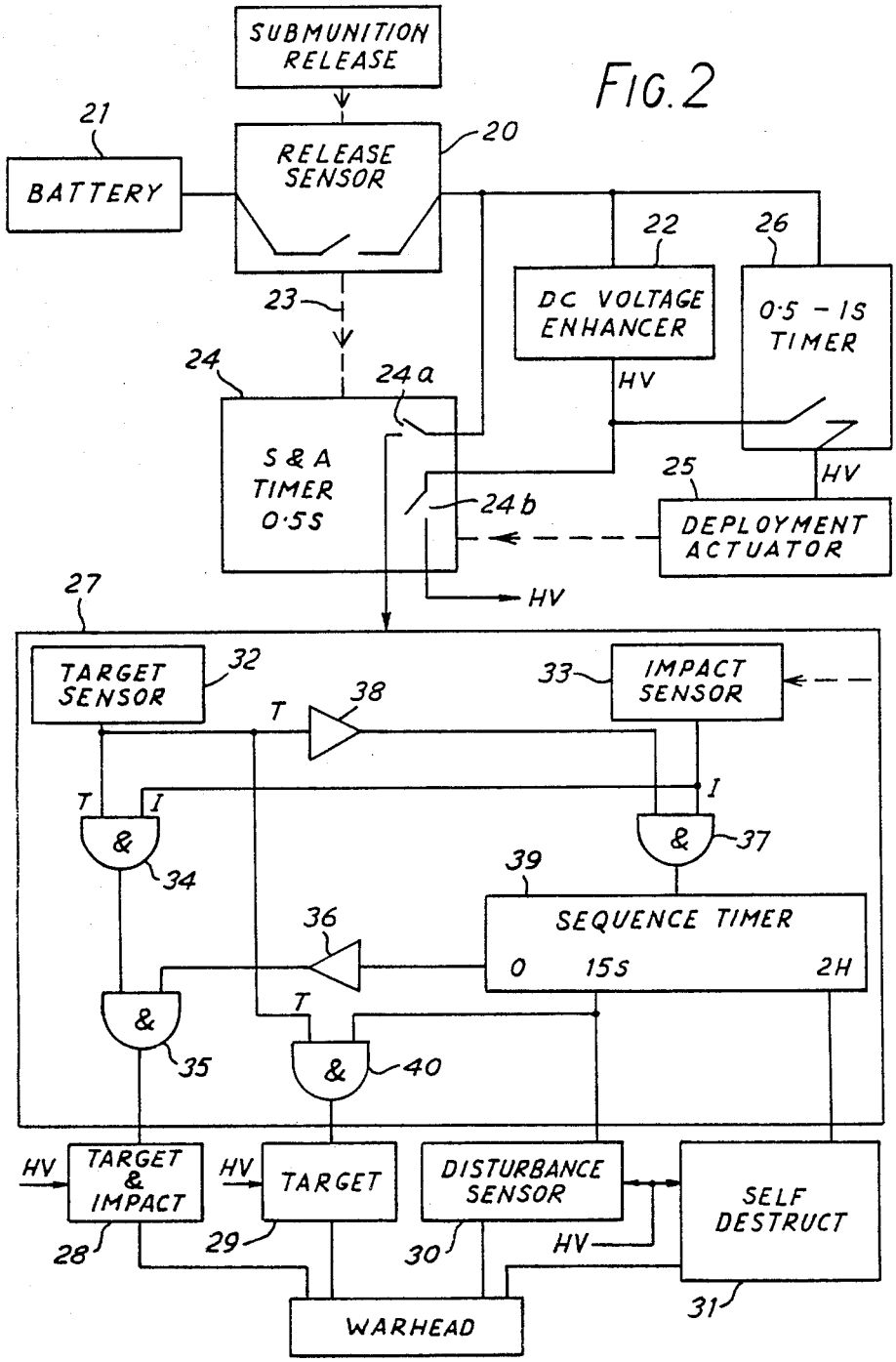
FIG. 2 is a block diagram of the safety and arming arrangement and the fuzing arrangement of the submunition.

The submunition of FIG. 1 includes:

a body 1; a parachute 2; a fuzing arrangement, as shown in FIG. 2 for detonating a warhead on impact with a metal target; and an extendable probe 3 in the form of a spring.

The fuzing arrangement includes a pulsed eddy current metal detector having a magnetic field producing and sensing element, in the form of a coil and an impact sensing element in the form of an impact switch; these elements are supported by the spring in a housing 4.

The body 1 contains a warhead which, for maximum effectiveness against a target, must be detonated at a preselected distance from the target. Furthermore, the warhead, and/or other components comprised by or contained by the body comprise metal which would interfere with the operation of the pulsed eddy current metal detector. Thus, the spring is arranged to support the impact switch at the preselected distance from the target so the warhead can be detonated with maximum effectiveness. Furthermore, by spacing the coil from the body 1 the interference with the operation of the metal detector in detecting targets is substantially reduced.

Many submunitions of the kind shown in FIG. 1 are packed into a container which is projected into the vicinity of a group of ground targets. The container releases the submunitions, which are scattered in the vicinity of the ground targets. Once a submunition is scattered, the parachute 2 is deployed and the spring 3 extends. The submunition descends to the ground. If it hits a metal target its warhead is detonated. If it does not hit a metal target, it adopts the role of a mine.

Referring to FIG. 2, a sensor 20 recognises the release of the submunition from the container to connect a battery 21 to a D.C. voltage enhancer 22, to a mechanical safety and arming timer 24 and to a 0.5–1 second timer 26. Operation of the release sensor also removes a first detent (schematically shown at 23) from the safety and arming timer 24. The timer 26 controls the operation of an actuator 25 for deploying the parachute 2. Deployment of the parachute removes a second detent from the timer 24.

The D.C. voltage enhancer 22 comprises capacitors, and means for charging them to a high voltage from the low battery voltage. The high voltage is required for detonation of the warhead, and also to operate the actuator 25. The charging means may be in the form of a cross-coupled multivibrator with a transformer load, or of a sliding bias class A oscillator circuit.

The 0.5–1 second timer 26 is actuated by the connection of the battery to it. It is preferably an electronic timer. For example it is a single period RC timer, a random distribution of time amongst the submunitions being obtained by a random use of capacitor/resistor values. A comparator circuit senses when the voltage, rising at a rate determined by the capacitor/resistior values across a capacitor is equal to a predetermined threshold. The timer then connects the enhancer 22 to the actuator 25, to cause the deployment of the parachute.

The safety and arming timer 24 comprises a mechanism which moves a warhead detonator into line with a stemming to complete an explosive train. This mechanism is freed by the removal of the two detents in response to the release sensor and in response to the deployment of the parachute. Once freed, the mechanism also closes two switches 24*a*, 24*b*. Switch 24*a* connects the battery 21 to a logic circuit 27 to energise that circuit, and switch 24*b* connects the D.C. voltage enhancer to circuit means 28, 29, 30 and 31, controlled by the logic circuit 27, for actuating the warhead.

The logic circuit 27 comprises a target sensor 32 for detecting a metal target, and an impact sensor 33. If impact with a metal target is detected an AND gate 34 produces a signal of value logic '1'. As will be made more clear hereinafter, an AND gate 35 receives a logic '1' signal from an inverter 36 in these circumstances together with the logic '1' signal from the gate 34. The logic '1' output of the gate 35 enables a switch 28 connecting the enhancer 22 to the warhead.

If impact is sensed, but no metal target is sensed, the submunition acts as a mine. An AND gate 37 then receives logic '1' signal from an inverter 38 and from the impact sensor 33. The gate 37 then actuates a sequencer timer 39. Upon actuation, the timer produces a logic '1' signal which is fed via the inverter 36 to disable the AND gate 35. (It will be appreciated that, when the timer 39 is not actuated, the inverter 36 receives a logic '0' signal to enable the gate 35).

After a suitable delay, e.g. 15S the timer enables a disturbance sensor 30 and also an AND gate 40. The disturbance sensor may be an anti-handling device such as a trembler switch or an anticlearance device, e.g. a switch actuated by a plough, which connects the enhancer 22 to the warhead when physically disturbed. The AND gate 40 is arranged to enable a switch 29 when a metal target is sensed by the sensor 32. The switch 29 then connects the enhancer 22 to the warhead.

If the warhead is not detonated after a long interval, e.g. 2 Hrs. the timer 39 enables a self-destruct switch 31 which connects the enhancer 22 to the warhead.

The sequencer timer 39 may comprise cascaded or parallel R-C timers, together with a logic circuit to provide suitable gating waveforms to the inverter 36, gate 40 and circuit means 30 and 31. Alternatively, an R-C oscillator may be used to drive a CMOS integrated circuit counter/decoder. A mechanical timer could be used.

The impact sensor 33 could comprise two annular contacts held apart by crushable foam. Impact forces would crush the foam allowing the contacts to meet and complete a circuit. The foam could be augmented or replaced by a conducting elastomer the resistance of which is a function of applied pressure. Alternatively, the switch could comprise a sealed housing containing conducting fluid medium (e.g. graphite powder or copper microspheres). The medium would be in two halves of the housing separated by a thin frangible membrane. The membrane fractures on impact allowing the medium to bridge electrical contacts in the two halves.

The target sensor 32 is an active metal sensor in the form of a pulsed eddy current metal detector. Various forms of such a detector are possible: e.g.

(a) In a coaxial coil system, two coils, aligned on the same axis are used. One coil is fed with A.C. while the signal induced into the second coil is nulled electronically. An eddy current disturbance causes unbalance.

(b) In an orthogonal coil system, one coil is supplied with A.C. but the receiving coil is inherently nulled due to the geometrical arrangement.

(c) In a single coil pulsed system one coil is used both as generator and detector. The coil is initially charged from a D.C. source. The current is switched off and the coil switched into the input of a high gain amplifier. Eddy currents are induced in any nearby metallic object when the current is turned off and these take a time to decay, of the order of a mS. The decaying eddy currents are detected by the coil. A non conducting material will not support eddy currents. This system is preferred.

Variations exist in the methods of detecting a disturbance. For example a nulled two coil system may simply have an amplifier threshold gate as a detector. Alternatively the two coils may be coupled in a self oscillating mode in which the increase in coupling caused by the disturbing object causes the loop gain to exceed unity. Another variation of the theme is the beat frequency oscillator approach where one coil is in a tuned circuit of an oscillator. This coil is screened from the disturbing object. A second, nominally identical oscillator is formed from the other coil subject to the effect of the target. If, under free space conditions the oscillator has zero beat, the presence of a target will detune one oscillator causing a detectable beat frequency.

Various modifications may be made. For example, instead of using a spring 3 as the extendable probe, a tubular telescopic probe may be used, or even an inflatable tube may be used.

Instead of using the sensor 32 to detect targets when the submunition acts as a mine, a separate metal detector could be used, or even a completely different sort of target sensor could be used, such as a simple radar sensor.

What I claim is:

1. A submunition having:

a fuzing arrangement including, a first sensor means, having a sensing element and responsive to the presence of metal to produce a first signal, second sensor means having an impact sensing element and responsive to impact to produce a second signal, third sensor means responsive to a stimulus to produce a third signal, actuating means responsive to the production of the first and second signals at the same time to produce a warhead actuating signal, and to the production of a said signal only by a preselected one of the first and second sensor means to actuate the third sensor means; a body comprising material which affects the operation of the sensing element; and a member extendable from the body to support the sensing element and an impact sensing element of the first and second sensor means respectively at a preselected distance from the body to reduce the affect of the said material on the sensing element and to sense impact with a metallic target at the preselected distance from the body.

2. A submunition according to claim 1, wherein the extendable member comprises a spring.

3. A submunition according to claim 1, wherein the extendable member comprises an inflatable tube.

4. A submunition according to claim 1, wherein the extendable member comprises a tubular telescopic probe.

5. A submunition according to claim 1, wherein the first sensor means comprises a single coil, means for energising the coil with D.C. pulses, and means for detecting energisation of the coil by eddy currents induced in the target by the pulses, the coil constituting the said sensor element.

6. A submunition according to claim 1 or 5, wherein the impact sensing element comprises two contacts held apart by crushable foam.

7. A submunition according to claim 1 or 5 wherein the impact sensing element comprises a housing including a pair of electrical contacts, a frangible member between the contacts, and conductive fluent particles arranged to bridge the contacts on breakage of the frangible member.

8. A submunition according to claim 1 wherein the third sensor is responsive to physical disturbance to produce the third signal.

9. A submunition according to claim 8, wherein the third sensor is an anti-handling device.

10. A submunition according to claim 1, wherein the actuating means is responsive to the production of the second signal alone to actuate the third sensor means.

11. A submunition according to claim 10, wherein the actuating means includes a timer responsive to the production of the second signal alone to actuate the third sensor means at a predetermined time after the production of the second signal.

12. A submunition according to claim 11, wherein the timer is arranged to produce a warhead actuating signal at a further predetermined time after the production of the second signal.

13. A submunition according to claim 11 or 12 wherein the actuating means comprises a gate connected to receive a signal indicative of a target and a signal from the timer indicative of the elapse of a preset time after the production of the second signal, to produce a warhead actuating signal.

14. A submunition according to claim 13, wherein the gate is connected to the said first sensor means to receive the said signal indicative of a target.

15. A submunition according to claim 13 wherein the gate is connected to a further sensor means to receive the said signal indicative of a target.

* * * * *